US005394797A

United States Patent [19]

Döbler et al.

[11] Patent Number: 5,394,797

[45] Date of Patent: Mar. 7, 1995

[54] MOUNTING FOR AN IMPRESSION CYLINDER EQUIPPED WITH A TUBE, WHICH CAN BE SLIPPED ON

[75] Inventors: Hermann Döbler, Plauen; Ulrich Seyffert, Syrau, both of Germany

[73] Assignee: Man Roland Druckmaschinen AG, Offenfach, Germany

[21] Appl. No.: 164,410

[22] Filed: Dec. 9, 1993

[30] Foreign Application Priority Data

Dec. 10, 1992 [DE] Germany ..... 42 41 565.9

[51] Int. Cl.[6] ..... B41F 5/00

[52] U.S. Cl. ..... 101/216; 101/247

[58] Field of Search ..... 101/216, 218, 139, 140, 101/247, 352, 382.1, 378, 415.1

[56] References Cited

U.S. PATENT DOCUMENTS

| | | | |
|---|---|---|---|
| 3,757,689 | 9/1973 | Koch et al. | 101/352 |
| 4,130,057 | 12/1978 | List et al. | 101/352 |
| 4,856,425 | 8/1989 | Kobler | 101/382.1 |
| 4,913,048 | 4/1990 | Tittgemeyer | 101/375 |
| 5,230,284 | 7/1993 | Kelm | 101/352 |
| 5,241,905 | 9/1993 | Guaraldi et al. | 101/216 |

FOREIGN PATENT DOCUMENTS

| | | |
|---|---|---|
| 543117 | 3/1930 | Germany . |
| 3715536 | 12/1988 | Germany . |
| 9110806 | 11/1991 | Germany . |
| 9115598 | 6/1992 | Germany . |

OTHER PUBLICATIONS

Copy of European Search Report (4 pages).

*Primary Examiner*—Ren Yan

*Attorney, Agent, or Firm*—Cohen, Pontani, Lieberman, Pavane

[57] ABSTRACT

A mounting for an impression cylinder equipped with a slipped on tube, in a rotary press. The axle journal of the cylinder is braced by way of a bearing an operating state against at least three supporting bodies. The supporting bodies can be shifted out of the area of an opening in a supporting frame to enable the tubes to be changed, as well as with respect to the position of the impression cylinder that is to be realized. The supporting bodies are supported in each case in the supporting frame so that they can be pivoted about an axis perpendicular to the supporting frame.

28 Claims, 6 Drawing Sheets

MOUNTING FOR AN IMPRESSION CYLINDER EQUIPPED WITH A TUBE, WHICH CAN BE SLIPPED ON

BACKGROUND OF THE INVENTION

1. Field of Invention

The invention relates to a mounting for an impression cylinder equipped with a slipped on tube, in a rotary press. The axle journal of the cylinder is braced in an operating state over a bearing against at least three supporting bodies, which can be shifted out of the area of an opening in the supporting frame enabling the tubes to be changed as well as with respect to the position of the impression cylinder that is to be realized.

2. Description of the Related Art

A mounting for an impression cylinder (German patent 37 15 536), for which a jaw chuck is movably held at the print unit side wall, is known. In this reference, a bearing, seated on the axle journal of the impression cylinder, is held in an operating state in the jaw chuck. Furthermore, the jaw chuck can be opened tip over the diameter of the tube and, in a holding position, can be adjusted for the impression cylinder by adjustable stops. Including the necessary driving mechanism, the jaw chuck, which can be opened up, requires relatively large space in the radial direction of the impression cylinder. However, only a very limited amount of space is available in the case of a multicylinder arrangement in a printing unit. Moreover, the straight-line motion mechanisms for the jaws are relatively expensive to manufacture.

SUMMARY OF THE INVENTION

It is therefore an object of the present invention to provide a mounting of the abovementioned type for an impression cylinder that is equipped with a tube which can be slipped on. This mounting enables the tubes in the rotary press to be changed with means that are simple to manufacture and require little space. Furthermore, the mounting is to ensure a functionally reliable, adjustable support for the axle journal of the impression cylinder in the operating state.

Pursuant to this object, and others which will become apparent hereafter, one aspect of the present invention resides in a mounting for an impression cylinder in which the supporting bodies are supported in the supporting frame so that they can be pivoted about an axis perpendicular to the supporting frame. The pivotable supporting bodies, including their mounting, can be manufactured easily at relatively little expense and do not require much space for the pivoting, so that an appropriate number can be installed even in the case of a multicylinder arrangement.

Most advantageously, the supporting bodies can be constructed as cams or as eccentrics. Due to a peripheral flattening of the supporting bodies, the free space in the area of the opening of the supporting frame, which is required for exchanging tubes, can be realized advantageously with a small pivoting angle of the supporting bodies.

The supporting bodies can be arranged in pocket-shaped recesses of the supporting frame to ensure a stable mounting of the supporting bodies and their accommodation in a tight or narrow space.

In a further embodiment of the invention, one of the side walls of the recesses as an insertable covering segment. This makes it possible for the supporting bodies, equipped on both sides with axle journals, to be supported easily and stably and installed without problems.

Additional embodiments provide a ring or segments which is or are connected to the supporting frame and have pocket-shaped recesses for the supporting bodies. This permits the supporting bodies to be disposed laterally at the supporting frame if, for design and manufacturing reasons, the recesses cannot be disposed in the supporting frame or if a rotary press is to be retrofitted subsequently with impression cylinders equipped with tubes.

Another embodiment provides that the pocket-shaped recesses are constructed as a continuous annular groove.

In still another embodiment, the pocket-shaped recesses are constructed so as to positively guide the respective supporting body equipped without a special mounting while ensuring the gliding capability of the supporting body. This makes it unnecessary to mount appropriately constructed, additional supporting bodies and enables supporting forces to be compensated for advantageously.

A further embodiment of the invention provides that the supporting bodies are in each case supported in the lateral walls of the pocket-shaped recesses or of the annular groove or in a covering segment of the pocket-shaped recesses inserted in a wall of the recesses.

In still a further embodiment, each supporting body at one axle journal engages a lever to which a working cylinder is linked that is operated by a pressure medium and is connected pivotably with the supporting frame. This permits the supporting body to be operated effectively with few transfer elements in a narrow space and can therefore be used particularly advantageously if several cylinders are disposed in a printing unit.

In another embodiment, the pivoting motion of the lever is limited by an adjustable stop which is connected with the supporting frame. The stop consists of a body fastened to the supporting frame and has a tapped hole penetrated by an adjusting screw which serves the lever as a stop. The adjustable stop enables the supporting body to be adjusted easily in the operating state as a function of the position of the impression cylinder.

The exchange of tubes is facilitated significantly through the use of a bearing bush, for centering the tube before it is pushed onto the impression cylinder. The bearing bush for the axle journal of the impression cylinder has an external diameter which is smaller than the internal diameter of the tube. The bearing bush can be equipped at the periphery of each of its two end faces with a leading slope which additionally aids the process of pushing on the tube.

It is also possible to use the outer ring of a ball bearing seated on the axle journal of the impression cylinder as the bearing bush.

The pivoting motions of the supporting bodies are mutually offset with respect to time and/or are partially individually controllable in opposite directions.

The separate control of the movements of the supporting bodies permit the course of their movement to be optimized as a function of the respective state of loading of the mounting. For example, the two supporting bodies under the greatest load should finally be turned on simultaneously and, in the same way however, be turned off first.

The supporting bodies can also be adjusted individually as a function of the position of the impression cylinder, by motor, electronically, and, if necessary, under the control of a computer. This makes it possible to use the invention for the realization of different positions of the impression cylinder, particularly for the impression throw-on and throw-off. For this purpose, the stops limiting the pivoting motion of the supporting body or, the supporting bodies for the impression throw-on and throw-off, can themselves, in each case, be adjusted as required by an electromotive, electronically controllable driving mechanism.

Pursuant to another embodiment, it is advantageous, in the sense of a uniform distribution of forces on the supporting bodies, to dispose the supporting bodies independently of the load and asymmetrically to the axle journal so that there is a lesser distance between the bodies in the direction of their maximum load.

A further embodiment provides that each supporting body is braced two-dimensionally in a curved recess at the periphery of a bearing bush of the axle journal of the impression cylinder. The curved recesses at the periphery of the bearing bush for the axle journal in each case enable the surface pressure between the supporting body and the bearing bush to be reduced and additionally, if necessary, twisting between these and, for example, an eccentric bush, to be prevented.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings:

FIG. 1 shows a side view of an inventive arrangement of supporting bodies for mounting an impression cylinder equipped with a tube, which can be slipped on;

DETAILED DESCRIPTION OF THE PREFERRED EMBODIMENTS

Figure 1:
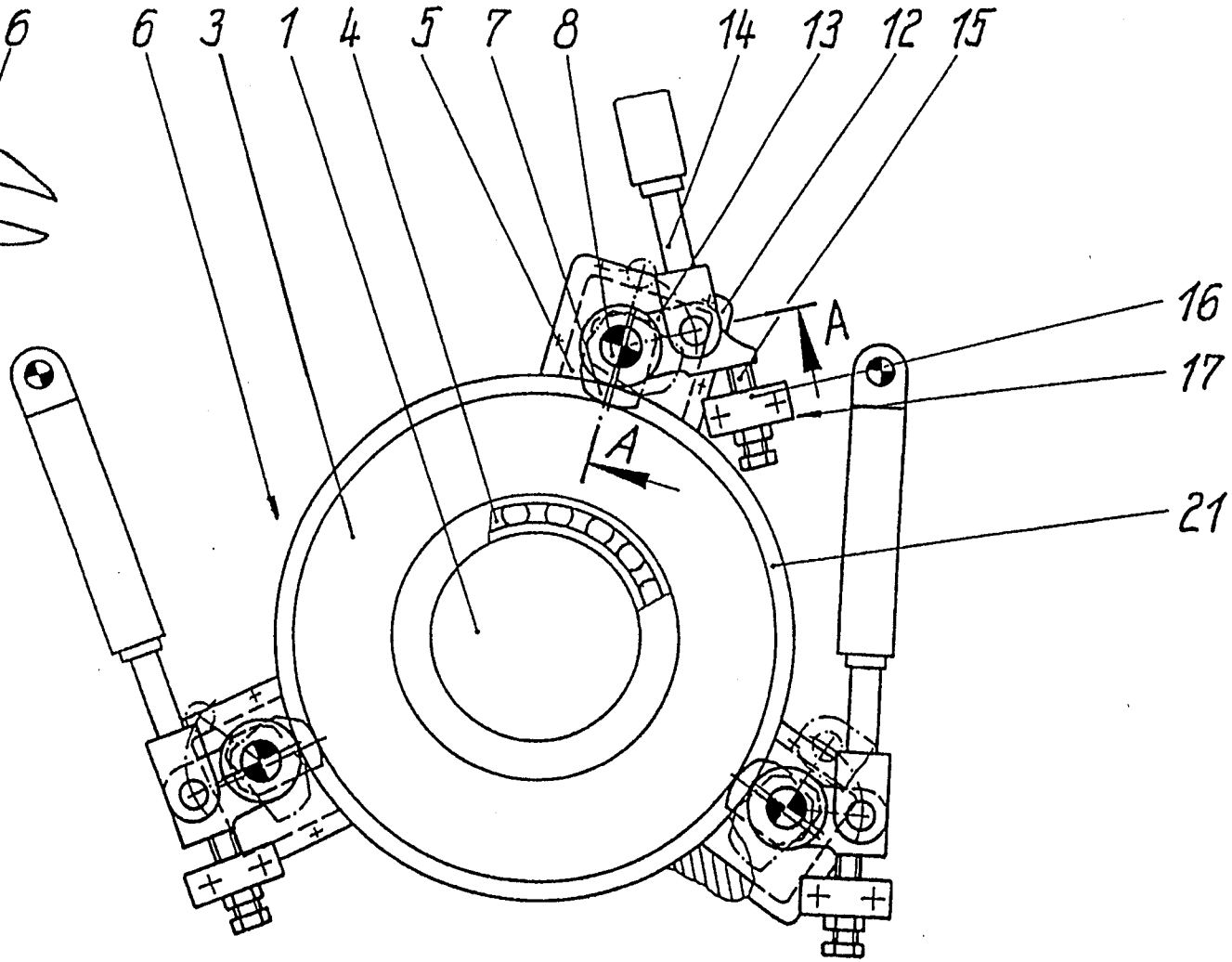

FIG. 1 shows in side view the axle journal 1 of an impression cylinder 2 (FIG. 2), on which a ball bearing 4 carrying a bearing bush 3 is disposed.

Figure 3:
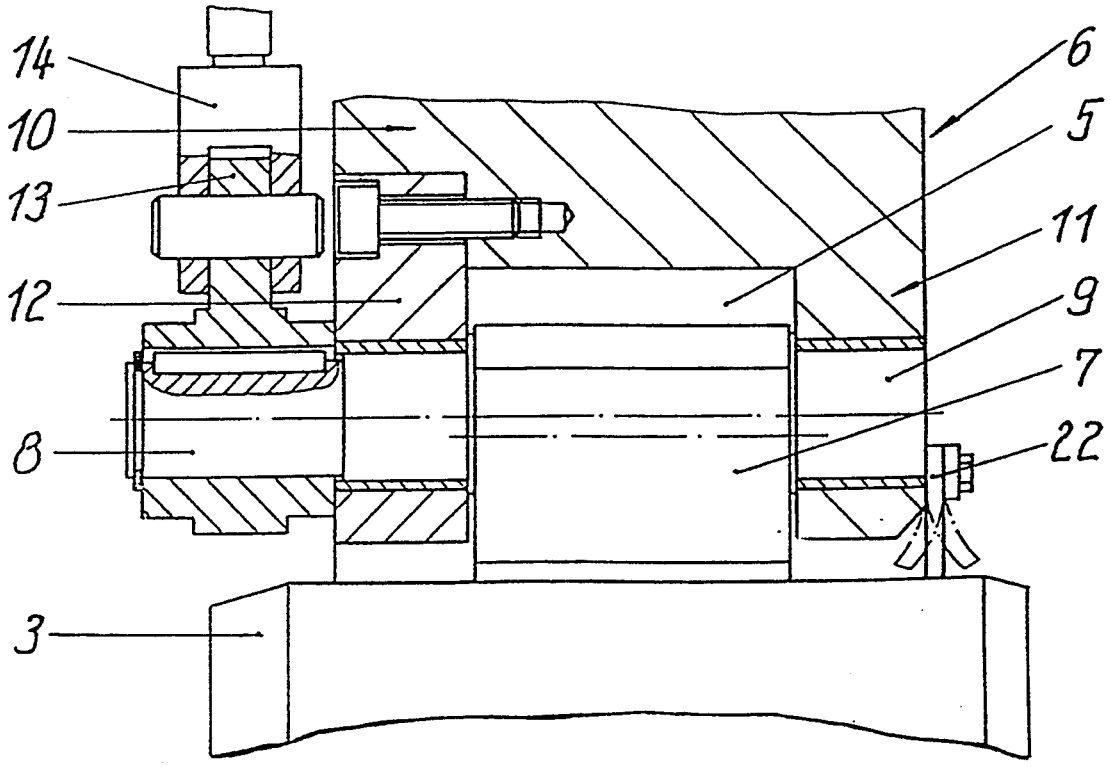
FIG. 3 shows a section along the line A—A of FIG. 1.

The bearing bush 3 is supported by three supporting bodies in the form of eccentrics 7, which are disposed approximately symmetrically in each case in pocket-shaped recesses 5 of a supporting frame 6 of the rotary press. The coaxial axle journals 8, 9 of each of the eccentrics 7 are supported on either side in the walls 10, 11 of the supporting frame 6 forming the lateral boundary of the recesses 5 (FIG. 3). For the purpose of ensuring the installation of the eccentrics 7, one wall 10 of each recess 5 is constructed as a covering segment 12, which is inserted in and bolted to the supporting frame 6.

Figure 11:
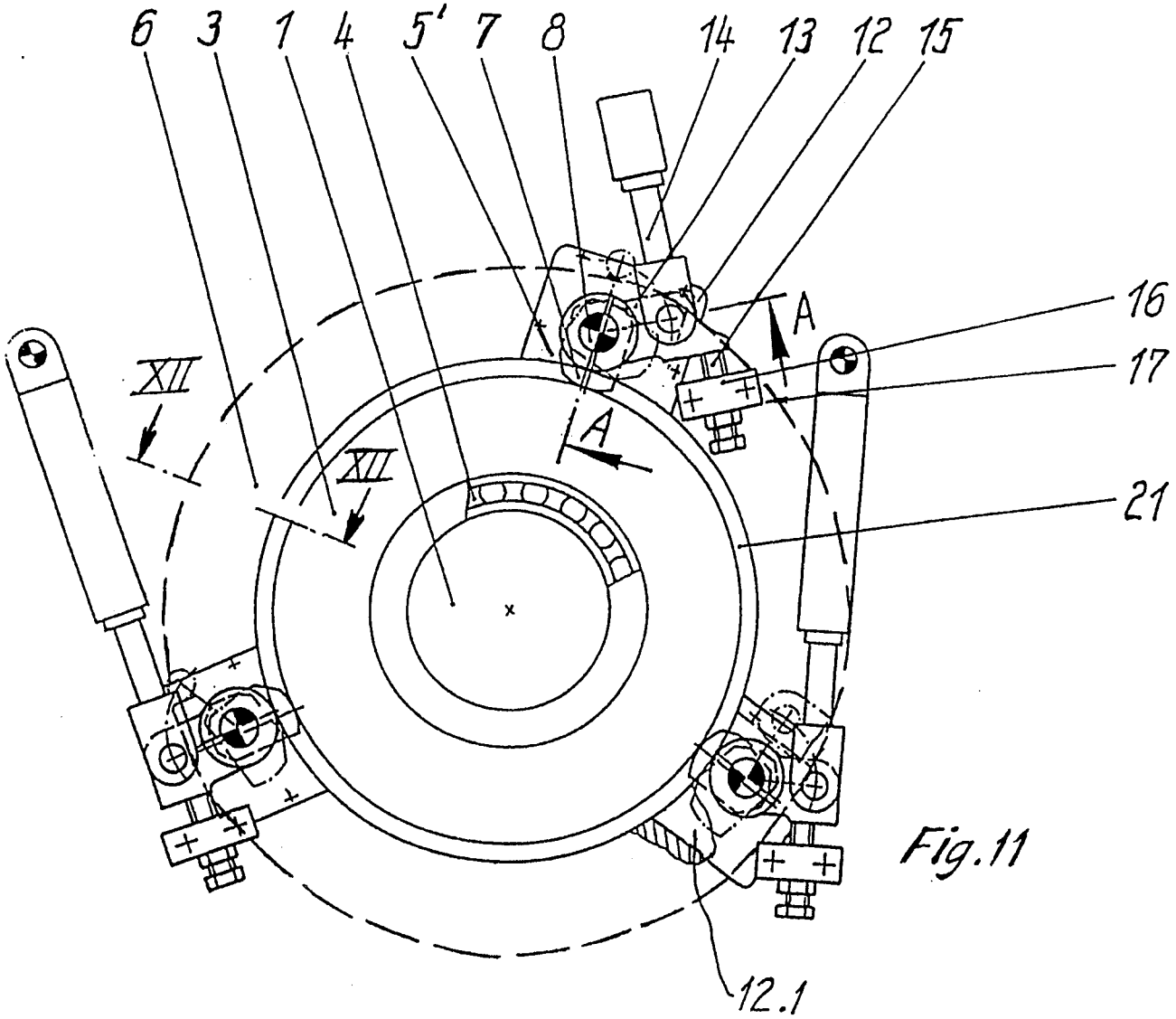
FIG. 11 shows another embodiment of the invention in a view similar to FIG. 1.
Figure 12:
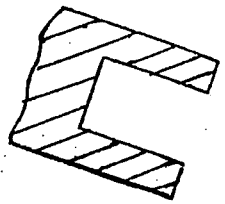
FIG. 12 shows a section along the line XII—XII of FIG. 11.

In a variation of the invention, the recess 5 can be replaced by a single annular groove 5′ in the supporting frame 6, as shown in FIG. 11. The annular groove 5′ holds all of the eccentrics 7. FIG. 12 shows the cross-section of the groove 5′, which corresponds to the cross section of the recess 5. Due to assembly or construction advantages, an opening 121 is retained by removing the covering segment 12.

On the axle journal 8 of the eccentric 7, protruding over the supporting frame 6 on the outside, a lever 13 is fastened (FIG. 3), to which a working cylinder 14 is linked (FIG. 1). The working cylinder is operated with a pressure medium and the lift thereof and, with that, the pivoting motion of the eccentric 7, is limited by an adjusting screw 15 which serves as a stop for the lever 13. The stop 17 consists of a body 16 having a tapped hole that is penetrated by the adjusting screw 15. The stop 17 is fastened to the supporting frame 6.

Figure 2:
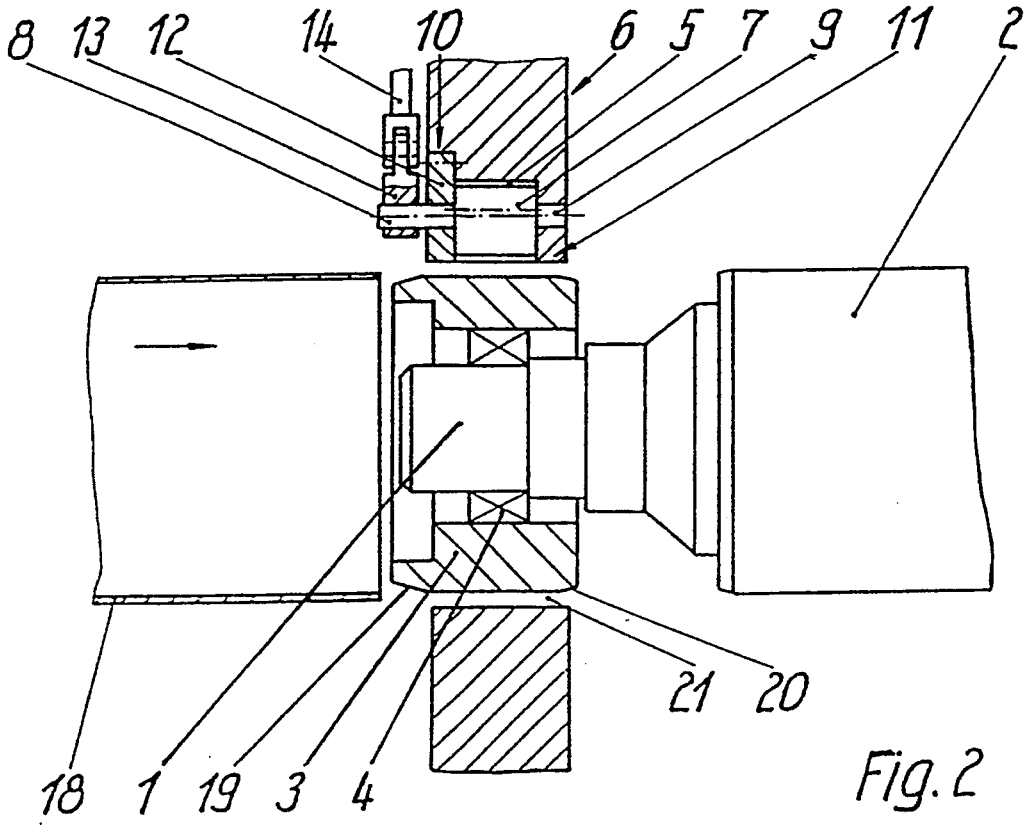
FIG. 2 shows a longitudinal section of the impression cylinder that is to be equipped with a tube, with supporting bodies swung out of the way.

FIG. 2 shows a tube 18, which is to be slipped onto the impression cylinder 2, the internal diameter of which is greater than the external diameter of the bearing bush 3. The bearing bush 3 is equipped at the periphery of each of its two end faces with a leading slope 19, 20, and serves for centering the tube 18 as it is being slipped on and ensures a clearance fit between the two.

For exchanging the tubes 18, the supporting bodies are swung back into the supporting frame 6 until the opening, which is constructed as a wall borehole 21 and is larger than the external diameter of the tube 18, is completely released. For this, the impression cylinder 2 is usually supported on the opposite side in a known way, which is not shown, in addition to the inventive mounting.

The gap between the bearing bush 3 and the wall borehole 21 is covered against contamination by a plastic sleeve 22, which is fastened to the supporting frame 6 and is elastically deformable when the tube 18 is being exchanged.

Figure 4:
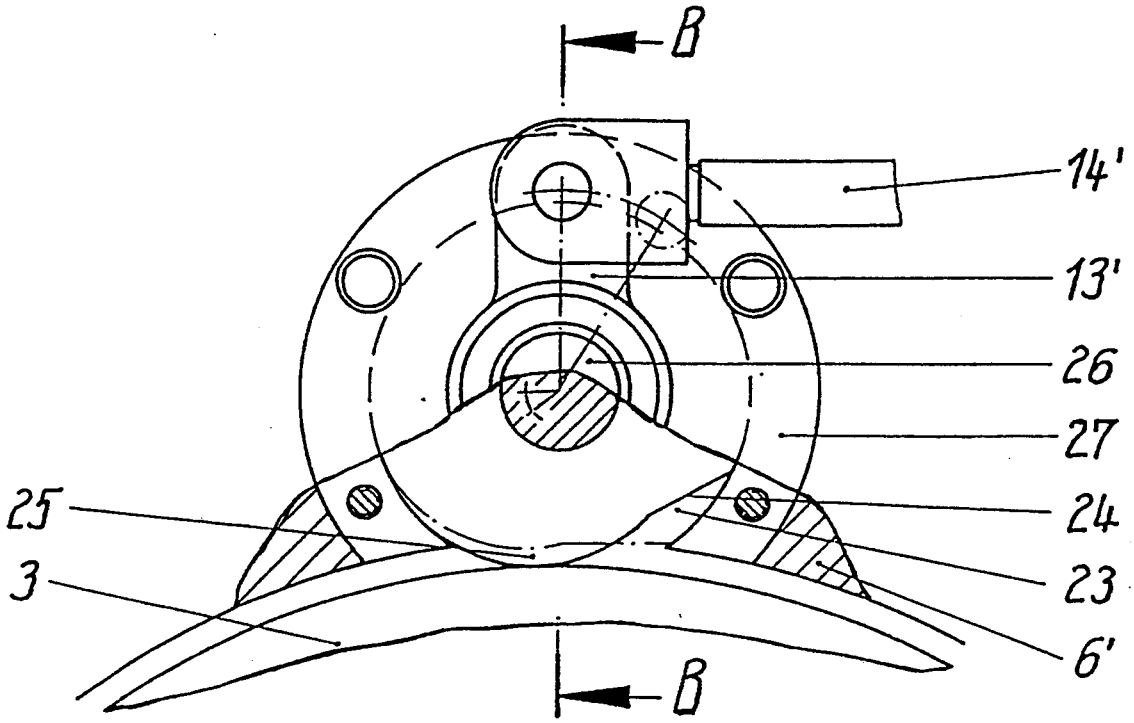
FIG. 4 shows a side view of a cam-shaped supporting body, guided positively in a recess of a supporting frame.
Figure 5:
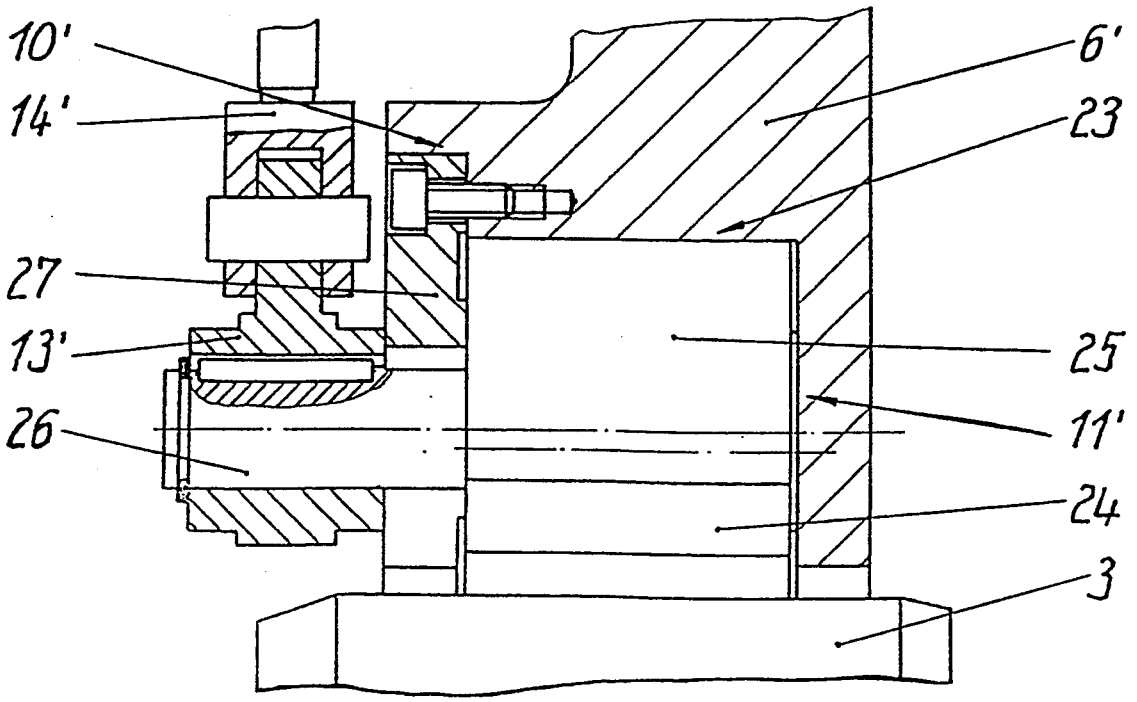
FIG. 5 shows a section along the line B—B of FIG. 4.

FIGS. 4 and 5 show a supporting body, which is constructed as a cam 25, guided peripherally and positively while guaranteeing the gliding capability by a pocket-shaped recess 23 in the supporting frame 6′. The cam 25 is equipped with different radii of curvature and a flattening 24 facilitating the exchange of tubes and on one side has an axle journal 26, which is not supported and is connected as in FIG. 5 by a lever 13′ with a working cylinder 14′. Functionally, the recess 23 is closed off on this side with a covering segment 27, which is inserted into and bolted to the supporting frame 6'.

Figure 7:
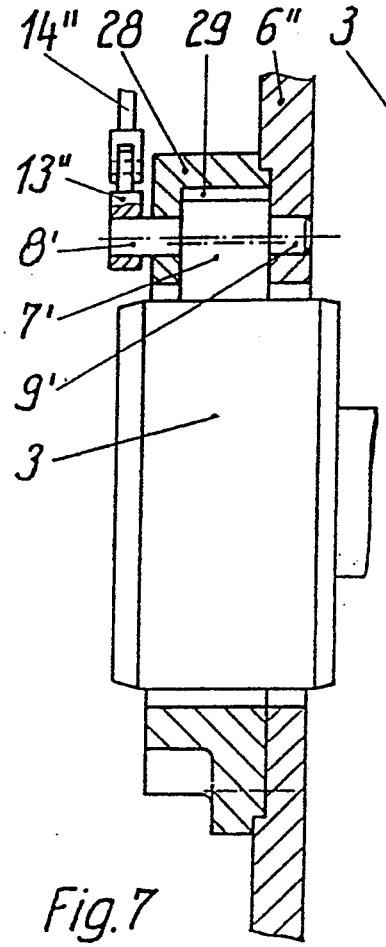
FIG. 7 shows a section along the line C—C of FIG. 6.
Figure 6:
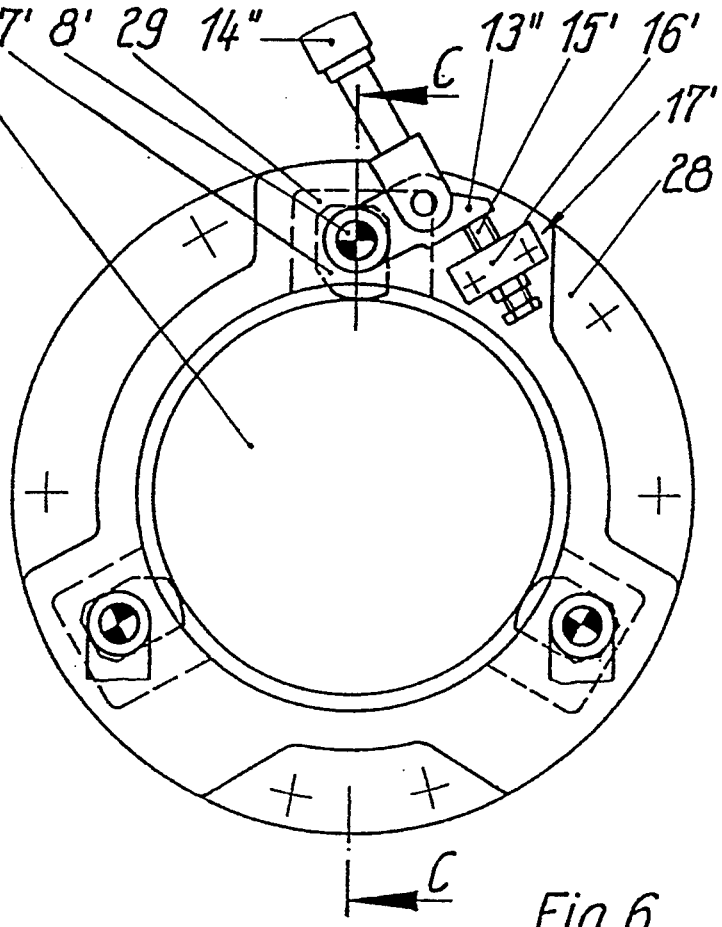
FIG. 6 shows a ring placed laterally on a supporting wall and equipped with pocketshaped recesses for the supporting bodies.

FIGS. 6 and 7 show a variation of the invention with a ring 28 which is placed externally on the supporting frame 6'' and bolted thereto. The ring 28 is equipped with the pocket-shaped recesses 29 that accommodate the eccentrics 7'. The eccentrics 7', supported on either side in the supporting frame 6'' or the ring 28, are equipped with a motion mechanism corresponding to FIG. 1.

Figure 14:
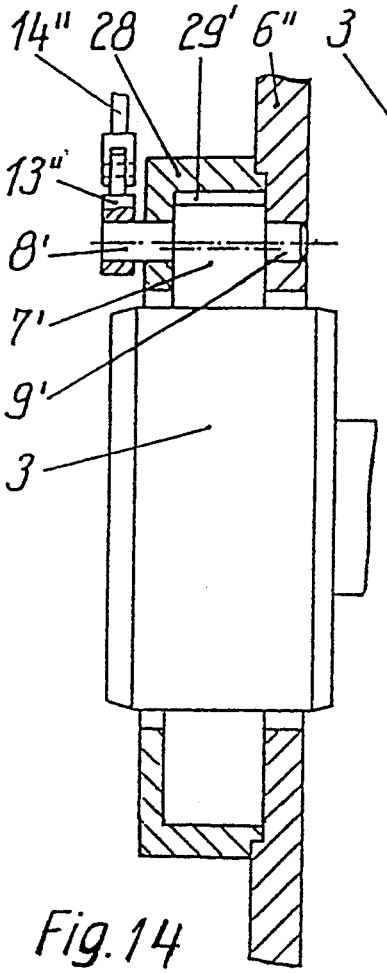
FIG. 14 shows a section along the line XIV—XIV of FIG. 13.
Figure 13:
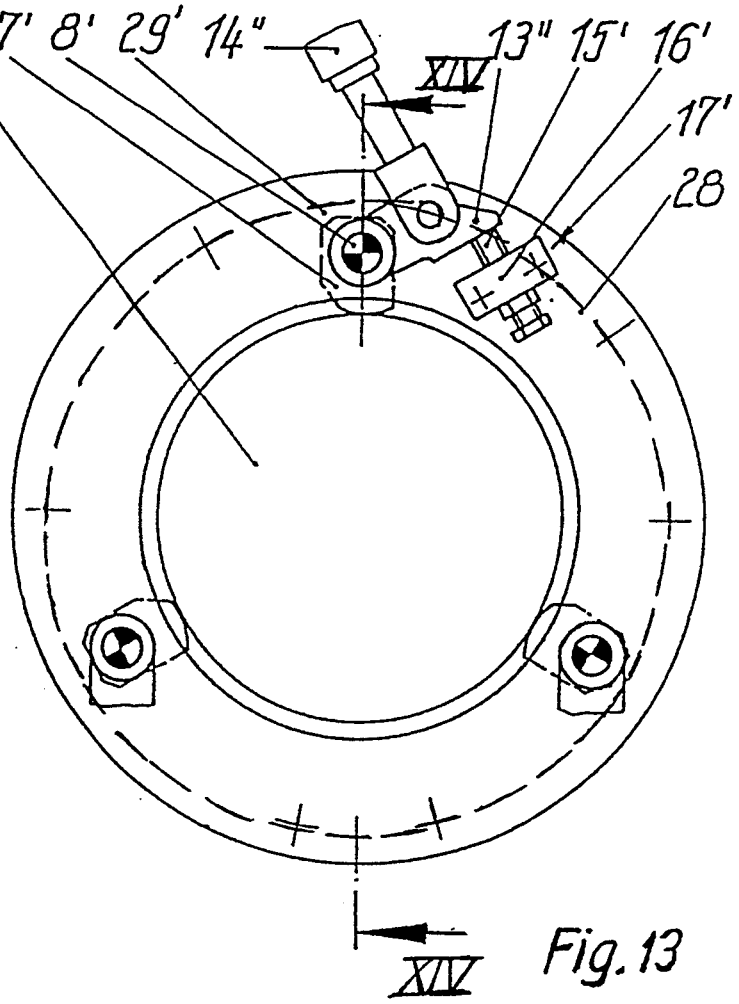
FIG. 13 shows a further embodiment of the invention in a view similar to FIG. 6.

FIGS. 13 and 14 show the pocket-shaped recesses constructed as a continuous annular groove 29' arranged in the ring 28, which annular groove holds all of the eccentrics 7'.

Figure 9:
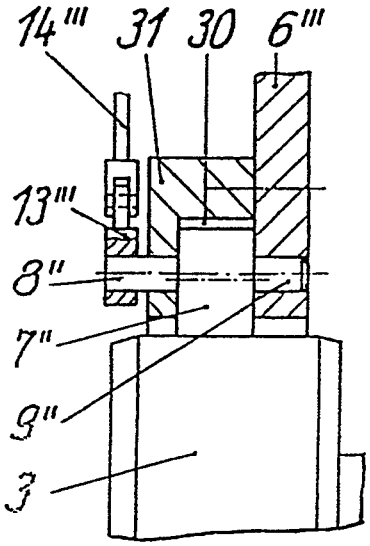
FIG. 9 shows a section along the line D—D of FIG. 8.
Figure 8:
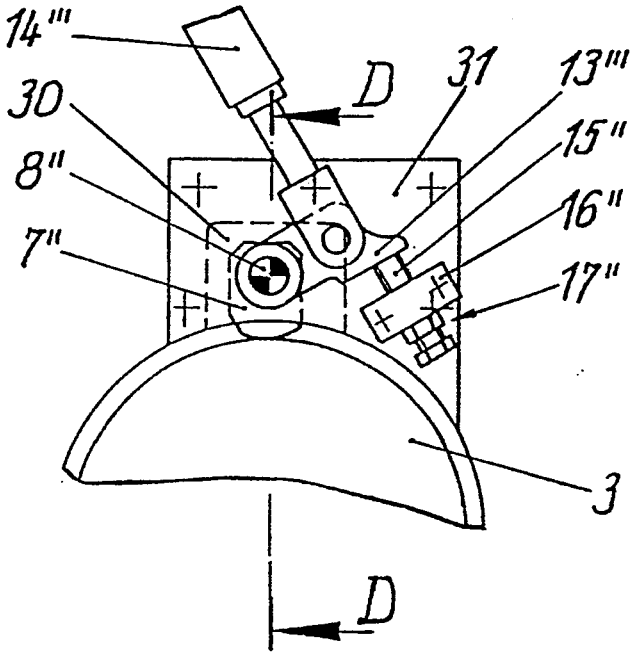
FIG. 8 shows a segment which is placed laterally on a supporting wall and is equipped with a pocket-shaped recess for a supporting body.

In FIGS. 8 and 9, the ring 28 is replaced by separate segments 31 bolted together with the supporting frame 6''' and equipped in each case with a pocket-shaped recess 30 for an eccentric 7''.

Figure 10:
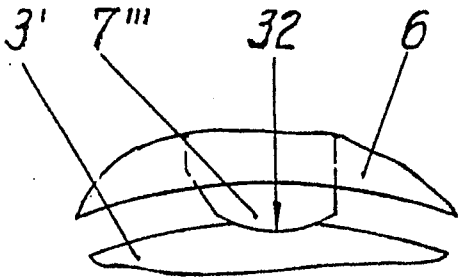
FIG. 10 shows a supporting body braced positively in a recess at the periphery of the bearing bush of the impression cylinder, as a section of a side view.

FIG. 10 shows a section of a bearing bush 3', which is equipped at its periphery with curved recesses 32, in which the respective eccentric 7''' is braced two-dimensionally and, with that, with lesser surface pressure. Because of the therewith associated positive fit in the peripheral direction of the bearing bush 3', the bush can thus be secured in a simple manner against twisting, for example, with respect to an additional eccentric bush.

It is advantageous if the movements of the supporting bodies can be controlled independently of one another, for example, offset with respect to time and in mutually opposite directions, since this makes possible an advantageous coordination with the respective load case.

It is also possible to adjust the stops limiting the motions of the supporting bodies or the motions of the supporting bodies themselves without stops by electronically controlled motors.

The latter possibility can be used, for example, to realize the impression throw-on and throw-off of an impression cylinder without the otherwise necessary, additional, adjustable eccentric bush, together with its adjusting mechanism. When the impression cylinder is adjusted by way of the supporting elements, it is, of course, necessary to ensure that the supporting elements lie constantly against the axle journal or its supporting bush, advantageously, for example, by a synchronous motion of eccentrics equipped with the same eccentricity. For this purpose, a computer, present in the rotary press, can be used.

The invention is not limited by the embodiments described above which are presented as examples only but can be modified in various ways within the scope of protection defined by the appended patent claims.

We claim:

1. A mounting for an impression cylinder having an axle journal and being equipped with a slipped-on tube, in a rotary press, comprising: a supporting frame having an opening therein; a bearing arranged on the axle journal; at least three supporting bodies pivotably mounted to the supporting frame, the at least three supporting bodies being pivotable between a first position in which the axle journal is braced in a desired position in an operating state over the bearing against the at least three supporting bodies, and a second position in which the supporting bodies are pivoted out of an area of the opening in the supporting frame so as to enable the tube to be changed; and at least three axle journals rotatably mounted to the supporting frame, each one of said axle journals being fixedly connected to a corresponding one of the supporting bodies so that the supporting bodies are pivotable about an axis perpendicular to the supporting frame.

2. A mounting as defined in claim 1, wherein each of the supporting bodies is a cam.

3. A mounting as defined in claim 1, wherein each of the supporting bodies is an eccentric member.

4. A mounting as defined in claim 2, wherein each cam has at least one peripheral flat portion adapted so as to be directed toward the cylinder axle journal in the position for a tube exchange.

5. A mounting as defined in claim 3, wherein each eccentric member has at least one peripheral flat portion adapted to be directed toward the cylinder axle journal in the position for tube exchange.

6. A mounting as defined in claim 1, wherein the supporting frame has pocket-shaped recesses, each of the supporting bodies being disposed in one of the pocket-shaped recesses of the supporting frame.

7. A mounting as defined in claim 6, wherein the supporting frame has walls which define the recesses, one of the walls of each recess, which laterally limits the recess, being a covering segment permanently mounted to the supporting frame.

8. A mounting as defined in claim 1, and further comprising a ring firmly placed laterally on the supporting frame while retaining the opening of said supporting frame, the ring having pocket-shaped recesses in which the supporting bodies are disposed.

9. A mounting as defined in claim 1, and further comprising a plurality of segment members each having a pocket-shaped recess, the segment members being firmly placed separately and laterally upon the supporting frame so as to maintain the opening of said supporting frame, one of the supporting bodies being disposed in each pocket-shaped recess.

10. A mounting as defined in claim 6, wherein a continuous annular groove is provided in the supporting frame so as to form the pocket-shaped recesses, all of the supporting bodies being mounted in the groove.

11. A mounting as defined in claim 8, wherein a continuous annular groove is provided in the ring, so as to form the pocket-shaped recesses, all of the supporting bodies being mounted in the groove.

12. A mounting as defined in claim 7, wherein each of the pocket-shaped recesses is adapted to positively guide the respective supporting body without a special mounting and to ensure a gliding capability of the supporting body.

13. A mounting as defined in claim 8, wherein each of the pocket-shaped recesses is adapted to positively guide the respective supporting body without a special mounting and to ensure a gliding capability of the supporting body.

14. A mounting as defined in claim 9, wherein each of the pocket-shaped recesses is adapted to positively guide the respective supporting body without a special mounting and to ensure a gliding capability of the supporting body.

15. A mounting as defined in claim 6, wherein the supporting frame forms a lateral wall for each of the pocket-shaped recesses, each of the supporting bodies being supported at the lateral wall of the corresponding pocket-shaped recess.

16. A mounting as defined in claim 10, wherein the supporting frame forms a lateral wall of the annular groove, each of the supporting bodies being supported at the lateral wall of the annular groove.

17. A mounting as defined in claim 9, wherein the supporting frame forms a lateral wall for each of the pocket-shaped recesses, each of the supporting bodies being supported at the lateral wall of the corresponding pocket-shaped recess.

18. A mounting as defined in claim 8, wherein the ring forms a lateral wall for each of the pocket-shaped recesses, each of the supporting bodies being supported at the lateral wall of the corresponding pocket-shaped recess.

19. A mounting as defined in claim 1, and further comprising, for each supporting body, a working cylinder operated by a pressure medium and pivotably connected with the supporting frame, and a lever linked to the working cylinder and engaging the axle journal of the supporting body.

20. A mounting as defined in claim 19, wherein the lever is adapted to execute a pivoting motion, and further comprising an adjustable stop connected with the supporting frame so as to limit the pivoting motion of the lever.

21. A mounting as defined in claim 20, wherein the adjustable stop includes a body fastened to the supporting frame and having a tapped hole, and an adjusting screw located in the tapped hole and penetrating the body so as to stop the lever.

22. A mounting as defined in claim 1, and further comprising a bearing bush for the axle journal of the impression cylinder supported in the operating state by the supporting bodies, the bearing bush having an external diameter which is smaller than an internal diameter of the tube so as to bring about a centering of the tube as it is pushed onto the impression cylinder.

23. A mounting as defined in claim 22, wherein the bearing bush has two end faces at the periphery of which a leading slope for the tube is provided.

24. A mounting as defined in claim 22, and further comprising a ball bearing seated on the axle journal of the impression cylinder, the ball bearing having an external ring that forms the bearing bush.

25. A mounting as defined in claim 1, wherein the supporting bodies are adapted to have shifting motions which are at least one of mutually offset with respect to time and partially individually controllable in opposite directions.

26. A mounting as defined in claim 1, wherein the supporting bodies are adapted to be individually adjustable as a function of position of the impression cylinder, and further comprising means for adjusting the supporting bodies.

27. A mounting as defined in claim 1, wherein the supporting bodies are disposed asymmetrically to a longitudinal central axis of the axle journal so that there is a lesser distance between said bodies in a direction of maximum load from the impression cylinder.

28. A mounting as defined in claim 1, and further comprising a bearing bush for the axle journal of the impression cylinder, a curved recess being provided at the periphery of the bearing bush, the supporting bodies each being braced two-dimensionally in the curved recess at the periphery of the bearing bush.

* * * * *